US008714926B2

(12) United States Patent
Lee et al.

(10) Patent No.: US 8,714,926 B2
(45) Date of Patent: May 6, 2014

(54) TURBINE COMPONENT COOLING CHANNEL MESH WITH INTERSECTION CHAMBERS

(75) Inventors: Ching-Pang Lee, Cincinnati, OH (US); John J. Marra, Winter Springs, FL (US)

(73) Assignees: Siemens Energy, Inc., Orlando, FL (US); Mikro Systems, Inc., Charlottesville, VA (US)

( * ) Notice: Subject to any disclaimer, the term of this patent is extended or adjusted under 35 U.S.C. 154(b) by 901 days.

(21) Appl. No.: 12/884,486

(22) Filed: Sep. 17, 2010

(65) Prior Publication Data

US 2012/0070306 A1 Mar. 22, 2012

(51) Int. Cl.
*F01D 5/18* (2006.01)

(52) U.S. Cl.
CPC ..... *F01D 5/187* (2013.01)
USPC ..... 416/97 R

(58) Field of Classification Search
CPC ..... F01D 5/18; F01D 5/182; F01D 5/187; F01D 5/188; F01D 5/189; F05D 2260/20; F05D 2260/204; F05D 2260/205
USPC ..... 415/115; 416/95, 96 R, 97 R, 97 A
See application file for complete search history.

(56) References Cited

U.S. PATENT DOCUMENTS

| | | | | |
|---|---|---|---|---|
| 5,370,499 | A | 12/1994 | Lee | |
| 5,690,472 | A | 11/1997 | Lee | |
| 6,086,328 | A | 7/2000 | Lee | |
| 6,902,372 | B2 | 6/2005 | Liang | |
| 6,981,840 | B2 | 1/2006 | Lee et al. | |
| 6,984,102 | B2 | 1/2006 | Bunker et al. | |
| 7,011,502 | B2 | 3/2006 | Lee et al. | |
| 7,182,576 | B2 * | 2/2007 | Bunker et al. | 416/96 R |
| 7,186,084 | B2 | 3/2007 | Bunker et al. | |
| 7,722,327 | B1 | 5/2010 | Liang | |
| 2005/0118023 | A1 * | 6/2005 | Bunker et al. | 416/97 R |
| 2005/0265837 | A1 | 12/2005 | Liang | |

FOREIGN PATENT DOCUMENTS

EP 1091092 A2 4/2001

* cited by examiner

*Primary Examiner* — Edward Look
*Assistant Examiner* — Jason Davis

(57) ABSTRACT

A mesh (35) of cooling channels (35A, 35B) with an array of cooling channel intersections (42) in a wall (21, 22) of a turbine component. A mixing chamber (42A-C) at each intersection is wider (W1, W2)) than a width (W) of each of the cooling channels connected to the mixing chamber. The mixing chamber promotes swirl, and slows the coolant for more efficient and uniform cooling. A series of cooling meshes (M1, M2) may be separated by mixing manifolds (44), which may have film cooling holes (46) and/or coolant refresher holes (48).

19 Claims, 5 Drawing Sheets

TURBINE COMPONENT COOLING CHANNEL MESH WITH INTERSECTION CHAMBERS

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

This invention relates to cooling channels in turbine components, and particularly to cooling channels intersecting to form a cooling mesh in a turbine airfoil.

BACKGROUND OF THE INVENTION

Stationary guide vanes and rotating turbine blades in gas turbines often have internal cooling channels. Cooling effectiveness is important in order to minimize thermal stress on these airfoils. Cooling efficiency is important in order to minimize the volume of air diverted from the compressor for cooling.

Film cooling provides a film of cooling air on outer surfaces of an airfoil via holes in the airfoil outer surface from internal cooling channels. Film cooling can be inefficient because so many holes are needed that a high volume of cooling air is required. Thus, film cooling is used selectively in combination with other techniques.

Perforated cooling tubes may be inserted into span-wise channels in an airfoil to create impingement jets against the inner surfaces of the airfoil. A disadvantage is that heated post-impingement air moves along the inner surfaces of the airfoil and interferes with the impingement jets. Also, impingement tubes require a nearly straight airfoil for insertion, but some turbine airfoils have a curved span for aerodynamic efficiency.

Cooling channels may form an interconnected mesh that does not require impingement tube inserts, and can be formed in curved airfoils. The present invention improves efficiency and effectiveness in a cooling channel mesh.

BRIEF DESCRIPTION OF THE DRAWINGS

The invention is explained in the following description in view of the drawings that show.

DETAILED DESCRIPTION OF THE INVENTION

Figure 1:
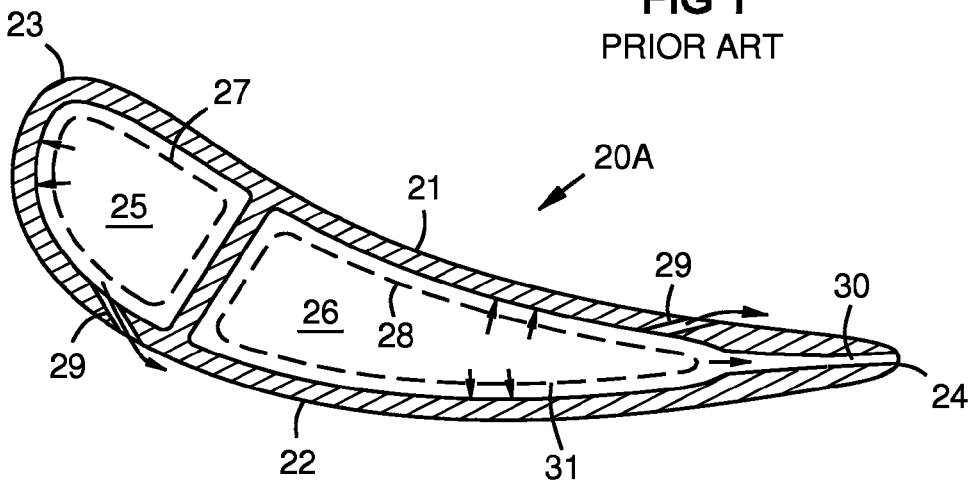
FIG 1 PRIOR ART
FIG. 1 is a transverse sectional view of a prior art turbine vane with impingement cooling inserts.

FIG. 1 is a transverse sectional view of a prior art turbine airfoil 20A with a pressure side wall 21, a suction side wall 22, a leading edge 23, a trailing edge 24, internal cooling channels 25, 26, impingement cooling baffles 27, 28, film cooling holes 29, and coolant exit holes 30. The impingement cooling baffles are thin-walled tubes inserted into the cooling channels 25, 26. They are spaced apart from the channel walls. Cooling air enters an end of each impingement baffle 27, 28, and flows span-wise within the vane. It exits impingement holes 31, and impinges on the walls 21, 22.

Figure 2:
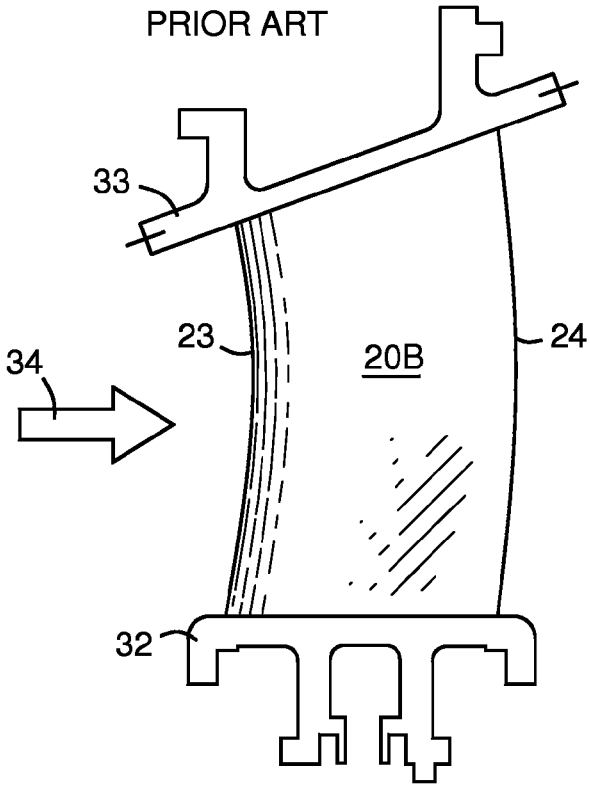
FIG 2 PRIOR ART
FIG. 2 is a side view of a prior art curved turbine vane airfoil between radially inner and outer platforms.

FIG. 2 is a side view of a prior art curved turbine vane airfoil 20B that spans between radially inner and outer platforms 32, 33. The platforms are mounted in a circular array of adjacent platforms, forming an annular flow path for a working gas 34 that passes over the vanes. This type of curved airfoil can make insertion of impingement baffles 27, 28 impractical, so other cooling means are needed.

Figure 3:
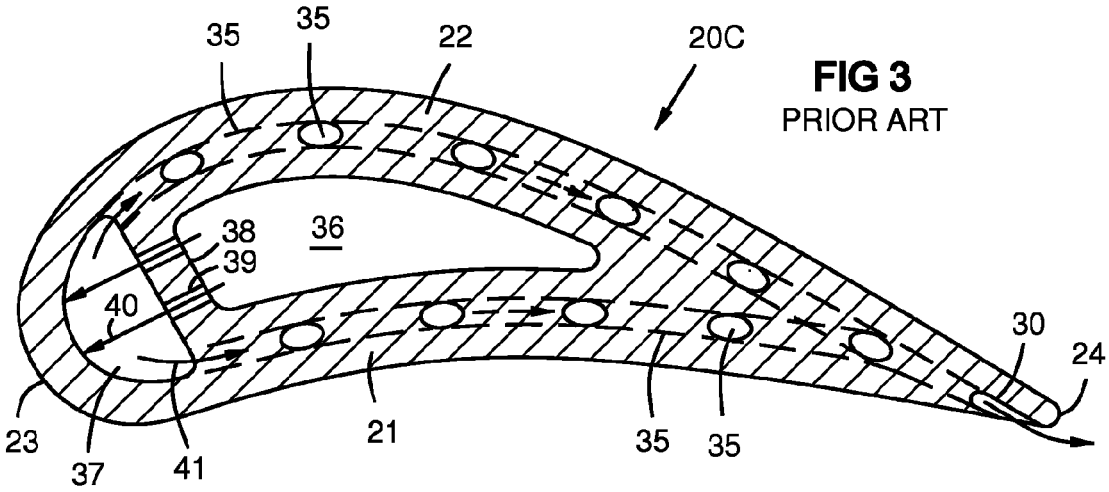
FIG 3 PRIOR ART
FIG. 3 is a transverse sectional view of a prior art turbine airfoil with mesh cooling channels.

FIG. 3 shows a prior art turbine airfoil 20C with a pressure side wall 21 and a suction side wall 22 and a cooling channel mesh 35. A coolant supply channel 36 is separated from a coolant inlet manifold 37 by a partition 38 with impingement holes 39. Coolant jets 40 impinge on the inside surface of the leading edge 23, then the coolant flows 41 into the mesh 35, and exits the trailing edge exit holes 30.

Figure 4:
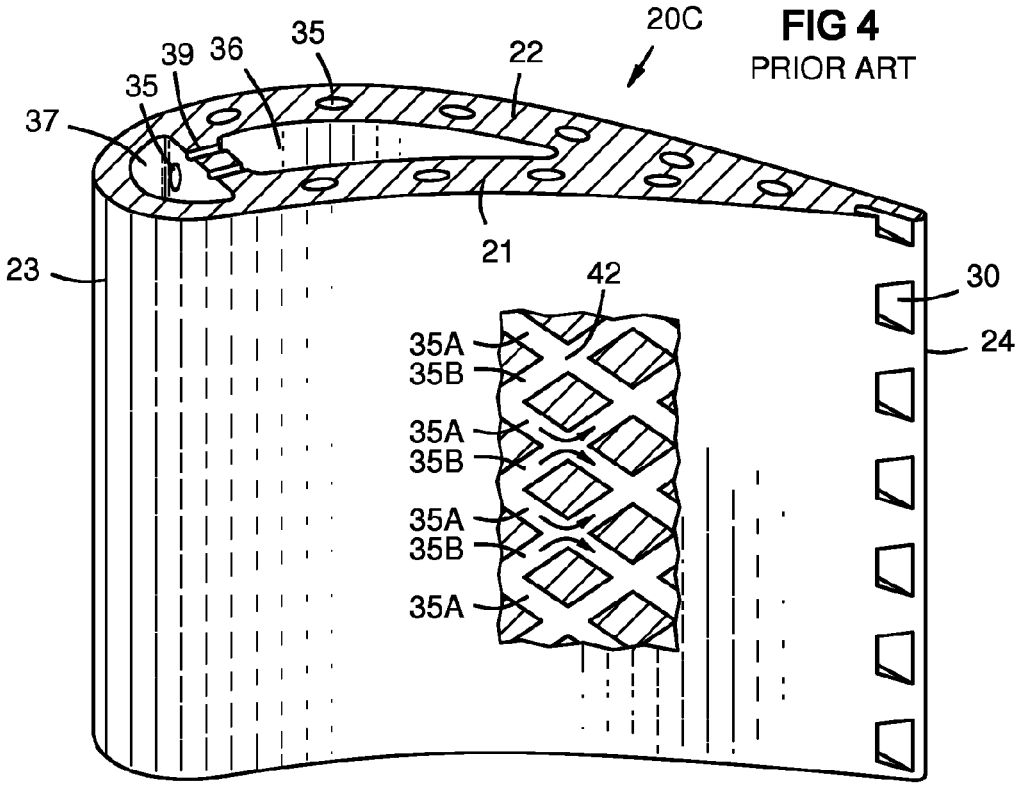
FIG 4 PRIOR ART
FIG. 4 is a perspective view of the prior art turbine airfoil of FIG. 3.

FIG. 4 shows a perspective view of the prior art turbine airfoil 20C of FIG. 3. The mesh 35 comprises a first plurality of parallel cooling channels 35A, and a second plurality of parallel cooling channels 35B, wherein the first and second plurality of cooling channels intersect each other in a plane or level below a surface of the airfoil, forming channel intersections 42. The cross-sectional shape of the cooling channels may be either circular or non-circular, including rectangular, square or oval.

Figure 5:
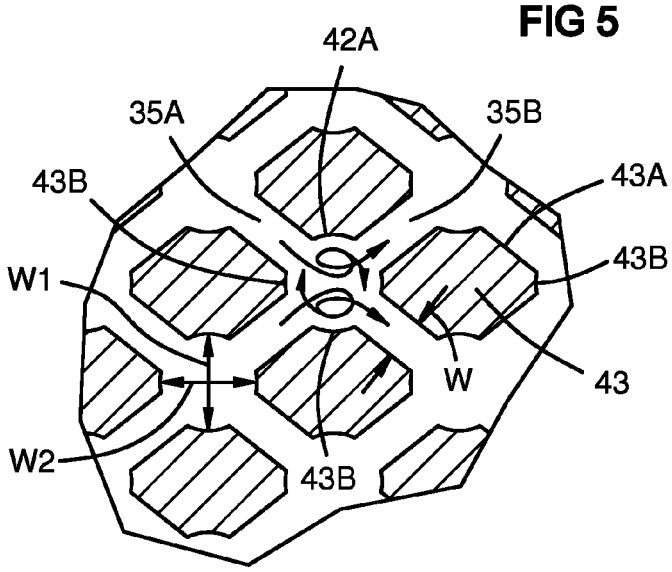
FIG. 5 is a sectional view of a cooling channel mesh per aspects of the invention.
Figure 8:
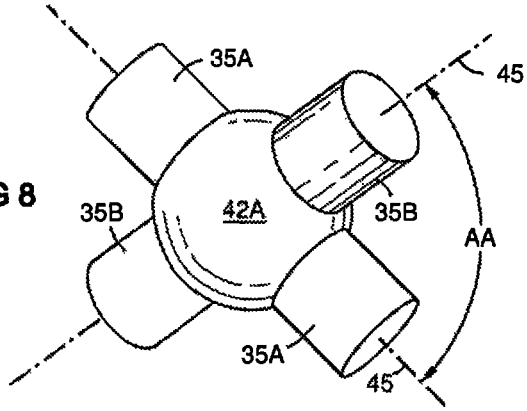
FIG. 8 is a perspective view of part of a casting core that forms a spherical mixing chamber per aspects of the invention.
Figure 9:
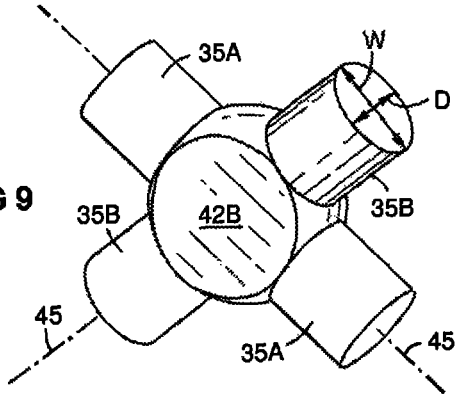
FIG. 9 is a perspective view of part of a casting core that forms a truncated spherical mixing chamber per aspects of the invention.
Figure 10:
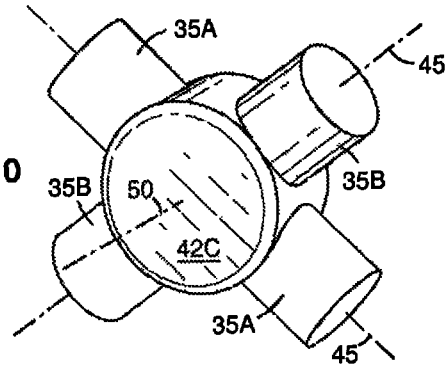
FIG. 10 is a perspective view of part of a casting core that forms a cylindrical mixing chamber per aspects of the invention.

FIG. 5 shows a cooling mesh per aspects of the invention. Each channel intersection has a mixing chamber 42A, which may be spherical or cylindrical. The mixing chamber delays the coolant flow, increasing heat transfer, and it provides a space and shape for swirl, increasing uniformity and efficiency of cooling. The mixing chambers 42A have a width W1 that is greater than a width W of each of the channels opening into the chamber. Each cooling channel 35A, 35B may have a width dimension W defined at mid-depth of the channel as shown in FIG. 9. The mid-depth may be defined by a geometric centerline 45 of the cooling channel as shown in FIGS. 8-10. The mixing chambers may have equal perpendicular widths W1, W2, thus providing a chamber shape that promotes swirl. If the mixing chambers are spherical or cylindrical, then each width W1, W2 is a diameter thereof. The term "width" herein refers to a transverse dimension measured at mid-depth 45 of the channels connected to the mixing chamber.

Spherical and cylindrical mixing chambers have spherical or cylindrical surfaces 43B between the four channel openings in the chamber. Solid parts 43 of the wall 21, 22 separate adjacent mixing chambers 42A and may have four channel surfaces 43A and four chamber surfaces 43B. Thus, the solid parts 43 may have eight surfaces alternating between straight channel surfaces 43A and spherical or cylindrical surfaces 43B. This geometry maximizes the surface area of the channels 35A, 35B for a given volume of the mixing chambers 42A, and provides symmetrical mixing chambers for swirl.

Figure 6:
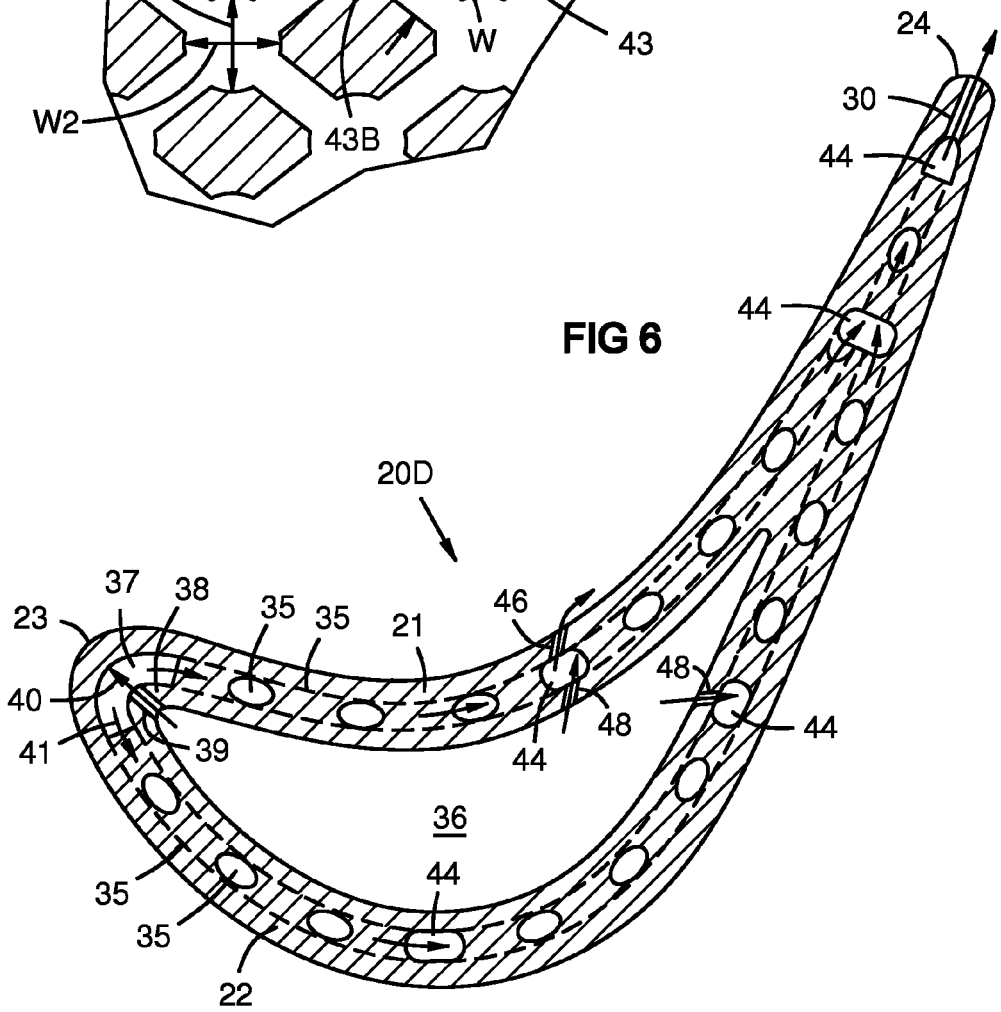
FIG. 6 is a transverse sectional view of an airfoil per aspects of the invention.

FIG. 6 is a sectional view of an airfoil per aspects of the invention. The cooling channel mesh 35 is formed in a layer below the surface of the walls 21, 22, as delineated by dashed lines. A coolant supply channel 36 may be separated from a coolant inlet manifold 37 by a partition 38 with impingement holes 39. Coolant jets 40 may impinge on the inside surface of the leading edge 23. Then the coolant flows 41 into the mesh 35, and exits the trailing edge exit holes 30. The mesh 35 may follow the design of FIG. 5. Periodic mixing manifolds 44 may be provided along the coolant flow path in the walls 21, 22 for additional span-wise mixing. These mixing manifolds 44 are closed off at the top and bottom. Film cooling holes 46 may pass between a mixing manifold 44 and an outer surface of the airfoil. Coolant refresher holes 48 may meter coolant from the coolant supply channel 36 into the mixing manifold 44. The refreshment coolant flowing into the manifold 44 not only reduces the temperature of the bulk fluid, but it also provides momentum energy along a vector for additional mixing within the manifold.

Figure 7:
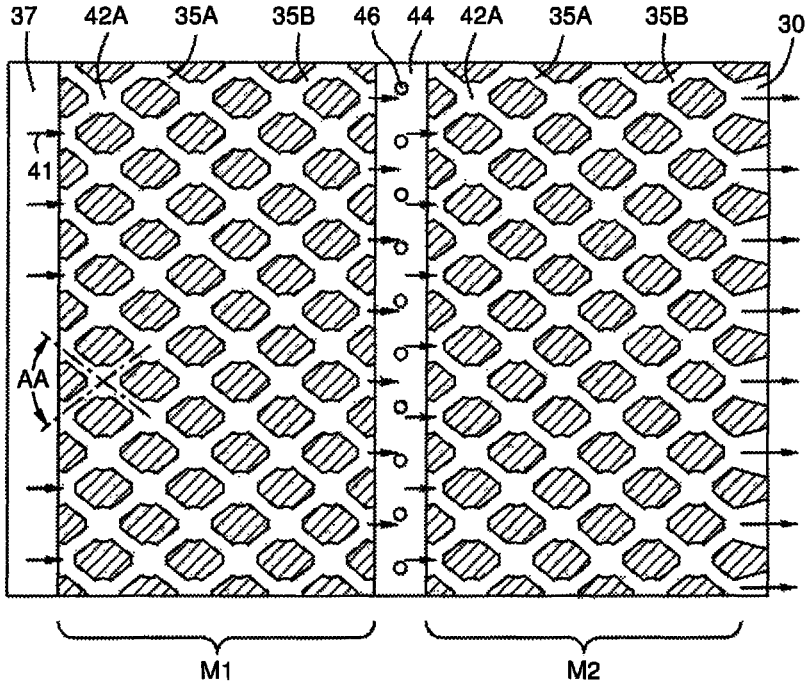
FIG. 7 is a sectional view of a series of two cooling meshes.

FIG. 7 is a sectional view of a series of two cooling meshes M1, M2, separated by a mixing manifold 44. A coolant inlet manifold 37 receives coolant via one or more supply channels from the turbine cooling system. The coolant inlet manifold 37 may be a leading edge manifold as shown in FIG. 6. Or it may be at another location, such as the locations of the mixing manifolds 44 shown in FIG. 6. Coolant 41 flows through the first mesh M1, and then enters a mixing manifold 44, which may include film cooling holes 46 and/or coolant refresher holes 48 as shown in FIG. 6. The coolant then flows through the second cooling mesh M2. This sequence of alternating meshes and mixing manifolds 44 may be repeated. Finally, the coolant may exit through trailing edge exit holes 30 or it may be recycled in a closed-loop cooling system not shown.

The intersection angle AA of the first and second cooling channels 35A, 35B may be perpendicular, or not perpendicular, as shown. Shallower intersection angles provide more direct coolant flow between the manifolds 37, 44. An angle AA between 60° and 75° provides a good combination of coolant throughput and mixing, although other angles may be used.

The meshes M1, M2 and/or the mixing chambers 42A-C may vary in size, density, or shape along a cooled wall depending on the heating topography of the wall. The mixing manifolds 44 may vary in spacing and type for the same reason. For example, coolant refresher holes 48 may be spaced more closely on the leading half of the pressure side wall 21 than in other areas. Likewise for film cooling holes 46. Both film cooling holes and refresher holes may be provided in the same mixing manifold 44 and they may offset from each other to avoid immediate exit of refresher coolant.

FIG. 8 illustrates part of a casting core that forms a spherical mixing chamber 42A by defining a volume that is unavailable to molten metal during a casting process. FIG. 9 illustrates part of a casting core that forms a spherical mixing chamber 42B that is truncated at opposite ends to the extent of depth range D of the channels 35A, 35B connected thereto. Truncation allows thinner component walls 21, 22. FIG. 10 illustrates part of a casting core that forms a cylindrical mixing chamber 42C with an axis 50 centered on the intersection and normal to the outer surface of the wall 21, 22. The cylindrical mixing chamber may be truncated to the depth range D of the connected channels 35A, 35B.

The mixing chambers may take shapes other than cylindrical or spherical. However, a cylindrical or spherical shape of the mixing chambers 42A-C beneficially guides the flow 41 into a circular swirl that provides predictable mixing, and maximizes the chamber volume while minimizing reduction of the channel length.

Herein, the term "cooling air" is used to mean any cooling fluid for internal cooling of turbine airfoils. In some cases, steam may be used. The term "straight channel" or "straight span" means a channel or segment thereof with a straight geometric centerline and without flared or constricted walls.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine component comprising:

a mesh of cooling channels comprising an array of cooling channel intersections in a wall of the turbine component;

a mixing chamber at each of a plurality of the cooling channel intersections;

wherein each mixing chamber comprises a width that is wider than a respective width of each cooling channel connected thereto; and wherein each mixing chamber comprises first and second widths that are perpendicular to each other and equal to each other, and wherein said two connected cooling channels comprise respective geometric centers that intersect each other at an angle of 60 to 75 degrees.

2. The turbine component of claim 1, wherein the cooling channels of the mesh are straight between the mixing chambers of the mesh.

3. The turbine component of claim 1, wherein each mixing chamber extends only within a depth range of said connected cooling channels.

4. The turbine component of claim 1, wherein each mixing chamber has a cylindrical or a spherical shape centered on the respective intersection and a diameter that is greater than the respective widths of the connected cooling channels.

5. The turbine component of claim 4, wherein each mixing chamber comprises a spherical geometry that is truncated at opposite ends thereof, limiting the mixing chamber to a depth range of said connected channels.

6. The turbine component of claim 4, wherein the mixing chambers of the mesh are separated by solid portions of the wall, each solid portion comprising eight surfaces, alternating between straight channel surfaces and spherical or cylindrical chamber surfaces.

7. The turbine component of claim 1, further comprising a coolant inlet manifold along an inlet side of said interconnected mesh and a coolant mixing manifold in the wall, wherein the coolant mixing manifold extends along both an outlet side of said interconnected mesh and along an inlet side of a second interconnected mesh defined according to claim 1 within the wall.

8. The turbine component of claim 7, wherein the coolant mixing manifold comprises coolant refresher holes that meter a coolant into the coolant mixing manifold from a coolant supply channel in the turbine component.

9. The turbine component of claim 7, wherein the coolant mixing manifold comprises film cooling holes that meter a coolant from the coolant mixing manifold to an outer surface of the wall.

10. The turbine component of claim 7, wherein the wall comprises film cooling holes that meter a coolant from the coolant mixing manifold to an outer surface of the wall and coolant refresher holes that meter the coolant into the coolant mixing manifold from a coolant supply channel in the turbine component, wherein the film cooling holes are offset from the coolant refresher holes.

11. The turbine component of claim 1, further comprising a refresher coolant inlet opening into each mixing chamber for delivery of fresh coolant thereto.

12. A turbine component comprising:

a first plurality of parallel cooling channels in a layer below a surface of a wall of the component;

a second plurality of parallel cooling channels in said layer;

wherein the first plurality of parallel cooling channels intersects the second plurality of parallel cooling channels at an angle to define an interconnected mesh of the cooling channels comprising an array of intersections of the cooling channels, each intersection comprising a mixing chamber;

wherein each mixing chamber comprises either a cylindrical shape with an axis centered on the intersection and normal to said surface or a spherical shape centered on the intersection;

wherein each mixing chamber has a diameter greater than a width of said each cooling channel of the intersection at a mid-depth of the respective cooling channel.

13. The turbine component of claim 12, wherein a respective mixing chamber extends only within a depth range of said each cooling channel of the intersection.

14. The turbine component of claim 12, wherein the mixing chambers of the mesh are separated by solid portions of the layer, each solid portion comprising eight surfaces alternating between straight channel surfaces and spherical or cylindrical chamber surfaces.

15. The turbine component of claim 12, further comprising a coolant inlet manifold along an inlet side of said interconnected mesh, and a coolant mixing manifold in the wall, wherein the coolant mixing manifold extends along an outlet side of said interconnected mesh.

16. The turbine component of claim 15, wherein the coolant mixing manifold comprises coolant refresher holes that meter a coolant into the coolant mixing manifold from a coolant supply channel in the turbine component.

17. The turbine component of claim 15, wherein the coolant mixing manifold comprises film cooling holes that meter a coolant from the coolant mixing manifold to an outer surface of the wall.

18. The turbine component of claim 15, wherein the wall comprises film cooling holes that meter a coolant from the coolant mixing manifold to an outer surface of the wall and coolant refresher holes that meter coolant into the coolant mixing manifold from a coolant supply channel in the turbine component, wherein the film cooling holes are offset from the coolant refresher holes.

19. A turbine airfoil comprising:

a first plurality of parallel cooling channels in a layer below a surface of an outer wall of the airfoil;

a second plurality of parallel cooling channels in said layer;

wherein the first plurality of parallel cooling channels intersects the second plurality of parallel cooling channels at an angle of 60 to 75 degrees in a first interconnected mesh of the cooling channels comprising an array of intersections of the cooling channels, each intersection comprising a mixing chamber that is wider than each cooling channel of the intersection at a mid-depth of said each cooling channel of the intersection;

wherein the cooling channels of the mesh are straight between the mixing chambers of the mesh;

a coolant inlet manifold along an inlet side of said first interconnected mesh;

a coolant mixing manifold in the wall along an outlet side of said first interconnected mesh and along an inlet side of a second interconnected cooling channel mesh within the layer; and wherein the coolant mixing manifold comprises film cooling outlet holes or coolant refresher inlet holes.

* * * * *